US005300984A

United States Patent [19]

Fuma et al.

[11] Patent Number: 5,300,984

[45] Date of Patent: Apr. 5, 1994

[54] IMAGE FORMING APPARATUS HAVING CONTROLLED TRANSFER UNIT

[75] Inventors: Hiroshi Fuma; Hisahiro Saitou; Mikihiko Takada, all of Hachioji, Japan

[73] Assignee: Konica Corporation, Tokyo, Japan

[21] Appl. No.: 997,918

[22] Filed: Dec. 29, 1992

[30] Foreign Application Priority Data

| | | | |
|---|---|---|---|
| Jan. 6, 1992 | [JP] | Japan | 4-000390 |
| Mar. 9, 1992 | [JP] | Japan | 4-050782 |
| Apr. 21, 1992 | [JP] | Japan | 4-101157 |

[51] Int. Cl.[5] ..... G03G 15/16

[52] U.S. Cl. ..... 355/208; 355/275

[58] Field of Search ..... 355/208, 271, 273, 274, 355/275, 309, 203

[56] References Cited

U.S. PATENT DOCUMENTS

| | | | |
|---|---|---|---|
| 3,642,362 | 2/1972 | Mueller | 355/309 |
| 5,153,653 | 10/1992 | Fuma et al. | 355/275 |
| 5,182,598 | 1/1993 | Hara et al. | 355/208 |

FOREIGN PATENT DOCUMENTS

| | | | |
|---|---|---|---|
| 1-133084 | 5/1989 | Japan | 355/273 |
| 3-38674 | 2/1991 | Japan | 355/273 |

*Primary Examiner*—Joan H. Pendegrass

*Attorney, Agent, or Firm*—Finnegan, Henderson, Farabow, Garrett & Dunner

[57] ABSTRACT

A transfer device for use in a copying machine includes a rotatable belt to convey a sheet to a transfer station and a conductive brush to provide the sheet with an electric charge so that the sheet is attracted onto the belt. An electric current passing through the brush is detected and a transfer condition for the sheet is controlled on the basis of the detected electric current.

9 Claims, 8 Drawing Sheets

IMAGE FORMING APPARATUS HAVING CONTROLLED TRANSFER UNIT

BACKGROUND OF THE INVENTION

The present invention relates to an image forming apparatus such as an electrophotographic copying machine. More specifically, the invention relates to an image forming apparatus for transferring a toner image, which is obtained by developing a latent image on an image carrying member, onto a recording paper by physical means using a transfer belt unit having a transfer belt which rotates, for conveying the recording paper with the toner image to fixing means, and for fixing the toner image by the fixing means.

Many methods and apparatuses for obtaining multicolor images by the electrophotographic method have been proposed. As one of them, a method for repeating the formation of latent images according to the number of decomposed colors of an original image on a photoconductor which is an image carrying member and developing them with color toners; for superimposing the multi-color toner images on the photoconductor; and for transferring them onto a transfer material so as to obtain a multi-color image has been proposed and executed. The basic process of multi-color image forming is mentioned in Japanese Patent Laid-Open Nos. 60-75850, 60-76766, 60-95456, 60-95458, and 60-158475 by the applicant of this specification.

In an image forming apparatus such as an electrophotographic copying machine, the peripheral surface of, for example, a photosensitive drum which is an image carrying member is uniformly charged by a charging unit and an image is exposed on the peripheral surface of the photosensitive drum so as to form an electrostatic latent image. This latent image is developed and visualized to a toner image by developing means. This toner image formed on the peripheral surface of the photosensitive drum is transferred onto a recording paper which is fed in exact timing by physical means, and the recording paper whereon the toner image is transferred is separated from the photosensitive drum and conveyed to fixing means. Further the toner image is fixed on the recording paper, and then the recording paper is ejected from the image forming apparatus.

As to transferring of the toner image, which is formed on the peripheral surface of the photosensitive drum, onto the recording paper, the recording paper is reversely charged to the charging of the toner by a transfer unit which discharges from the back of the recording paper and transferred onto the recording paper. After transferring, the recording paper is discharged by a high AC voltage applied by a separation unit and separated from the photosensitive drum. However, it is difficult to surely maintain the transfer property and separation property. Particularly, when the diameter of the photosensitive drum is large, the recording paper cannot be separated easily; that is, after the toner image is transferred, the recording paper is kept adhered to the photosensitive drum without being separated, causing jamming. A transfer belt unit is used as an art for improving this disadvantage.

The transfer belt unit rotates a transfer belt which is stretched by a plurality of holding rollers at the same speed as that of the photosensitive drum. The above transfer belt unit has charging means for supplying an electric charge to the recording paper so as to adhere to the transfer belt by electrostatic force. The recording paper which is adhered to the transfer belt comes in contact with the photosensitive drum in the transfer section and a high voltage which is reverse to the charging of the toner is applied to the recording paper in the transfer section under constant current control so as to transfer the toner image. In such a transfer belt unit, a high transfer efficiency and separation effect can be obtained in the transfer section.

Such a transfer belt unit can be used as a particularly desirable unit in a color image forming apparatus for superimposing toner images on the photosensitive drum and for transferring them onto the recording paper at a time. In such a color image forming apparatus, a plurality of developing units are mounted at the periphery of the photosensitive drum so as to superimpose toner images on a photoconductor, so that the drum diameter increases, and a sufficient separation performance cannot be obtained by the conventional electrostatic transfer and separation method, and a sure separation performance is necessary. Furthermore, the method for superimposing toner images requires a large amount of adhering toner, so that a large transfer charge is necessary and a large transfer charge holding capacity is necessary. The transfer belt unit is superior in the above two points.

When the aforementioned image forming apparatus is installed in a humid place or used in a humid season, the resistance of a recording paper is changed because the recording paper absorbs moisture and the water content increases, and toner images formed on the photosensitive drum are transferred defectively, and the image quality lowers. When the humidity is low, the transfer current becomes insufficient and toner images are transferred defectively.

To solve the above problems, a heater is used conventionally to heat a recording paper. However, it is impossible to finely adjust the humidity by heating according to the percentage of moisture content of the recording paper. Furthermore, a method that a temperature and humidity meter is mounted in an image forming apparatus so as to detect changes in the environment and to set the transfer conditions or a method that measuring means for measuring the resistance of a recording paper is mounted so as to set the transfer conditions from the measured resistance is conventionally used. However, new installation of such means causes a complicated structure and an increase in cost.

The object of the present invention is to provide an image forming apparatus having a transfer belt unit for allowing good transfer regardless of the temperature and humidity or the paper type without using such a complicated means.

SUMMARY OF THE INVENTION

To accomplish the above object, the present invention presents an image forming apparatus for transferring a toner image, which is obtained by developing a latent image on an image carrying member, onto a recording paper by a transfer belt, unit having a rotating transfer belt and for conveying the recording paper. The image forming apparatus includes charging means for supplying an electric charge to the recording paper and attracting the recording paper to the transfer belt is installed, means for detecting a current flowing through the charging means via the recording paper, and means for controlling the transfer conditions by the detected current.

DETAILED DESCRIPTION OF THE PREFERRED EMBODIMENTS

Figure 1:
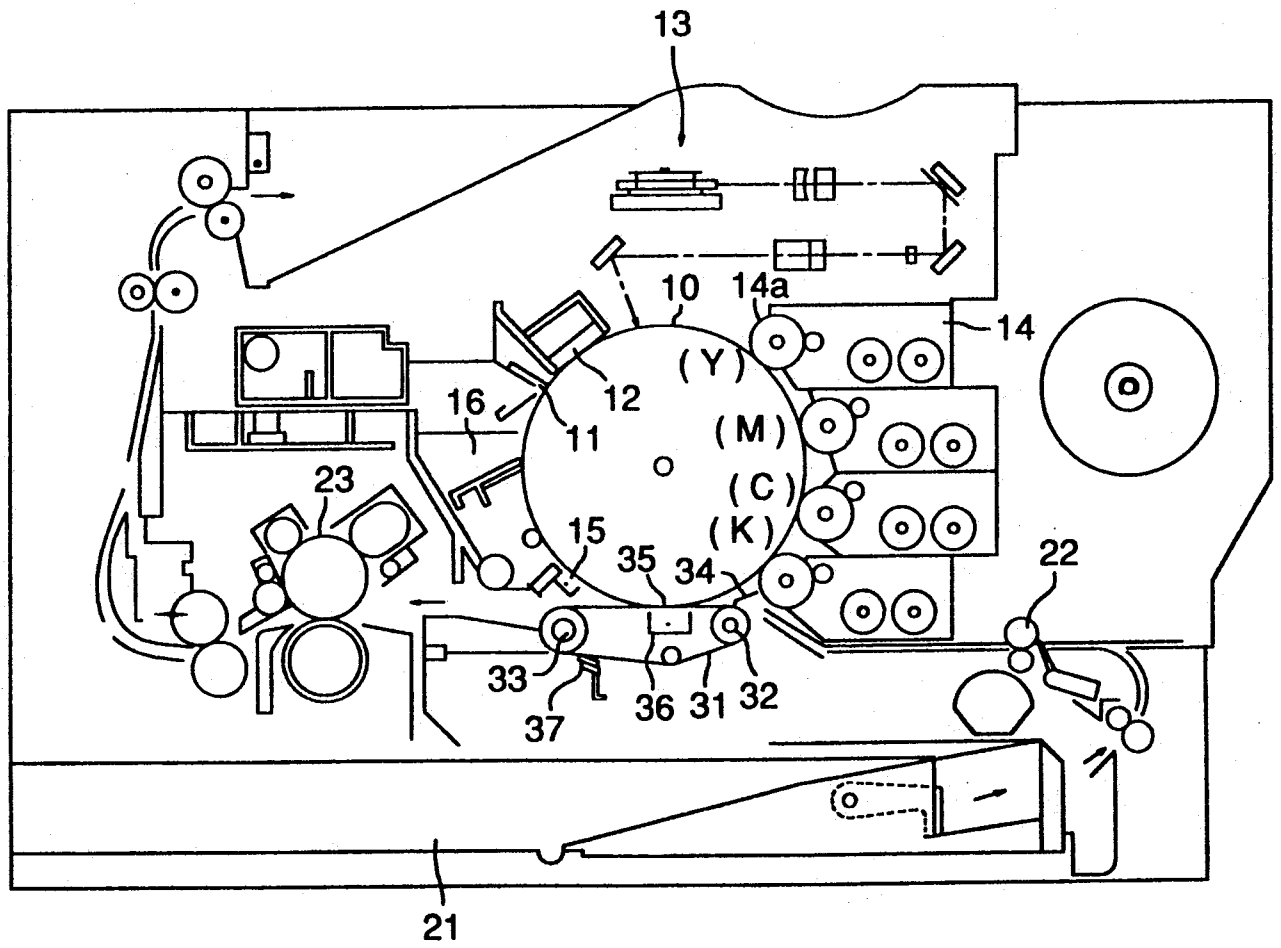
FIG. 1 is a sectional view of an embodiment of the image forming apparatus of the present invention.
Figure 5:
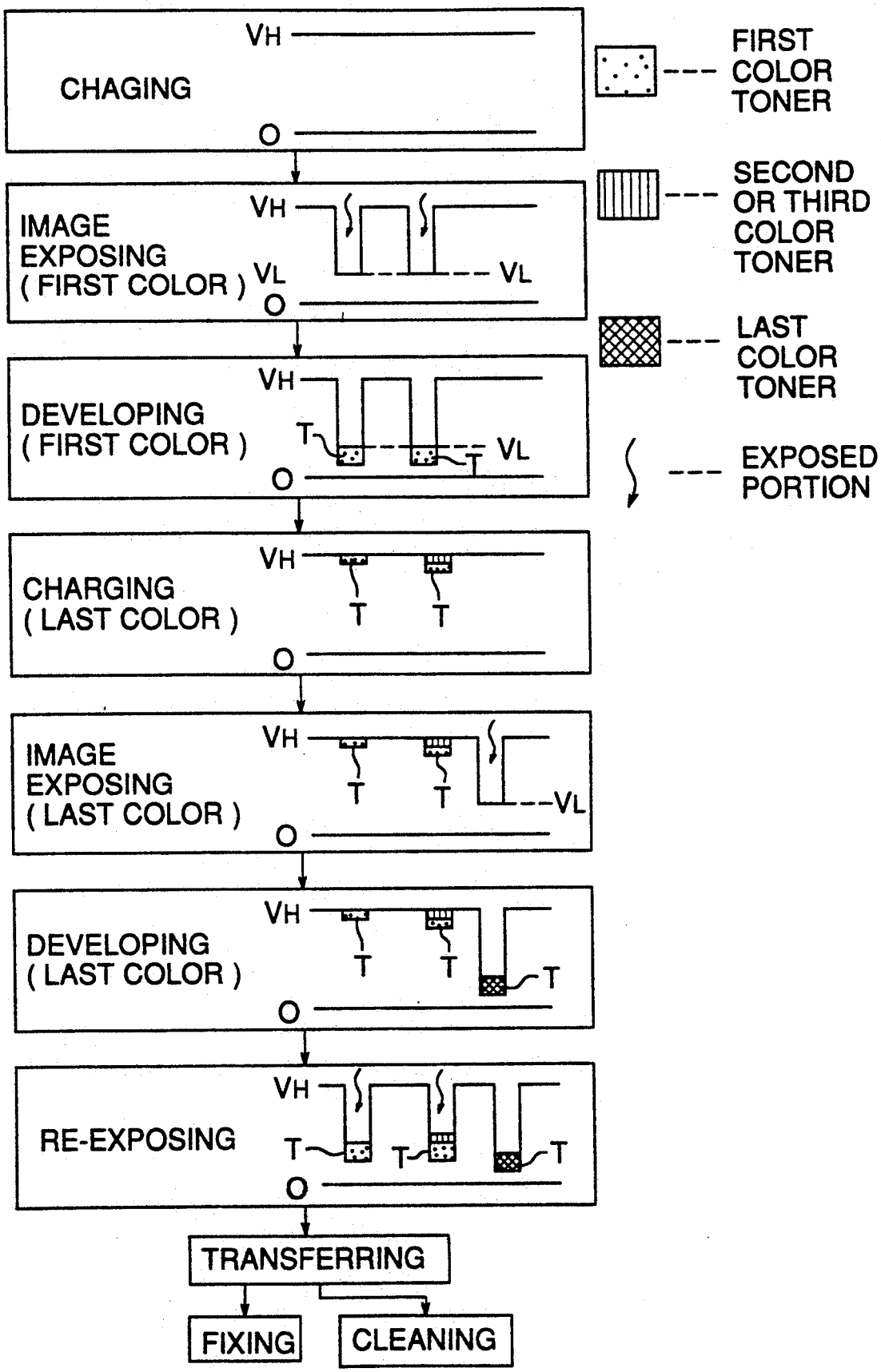
FIG. 5 is a flow chart showing changes in the potential of an image carrying member when a multi-color toner image is formed in the embodiment shown in FIG. 1.

FIG. 1 is a sectional view showing the structure of a color image forming apparatus as an embodiment of the image forming apparatus of the present invention and FIG. 5 is a flow chart showing changes in the potential of an image carrying member when a multi-color toner image is formed in this embodiment. The basic structure and operation of this embodiment will be explained with reference to FIGS. 1 and 6.

In FIG. 1, numeral 10 indicates a photosensitive drum which is an image carrying member. The photosensitive drum is coated with, for example, an OPC photoconductor and grounded so as to rotate clockwise. Numeral 12 indicates a scorotron charging unit which uniformly charges the peripheral surface of the photosensitive drum 10 at negative VH (−600 to −800 V) by corona discharge by a grid which is held at a predetermined potential VG (−550 to −850 V) and a corona discharge wire. Before charging by this scorotron charging unit 12, to eliminate the history of the photoconductor up to preprinting, the peripheral surface of the photoconductor is exposed to light by PCL11 using a light emission diode so as to discharge it.

After the photosensitive drum 10 is uniformly charged, an image is exposed by a laser writing unit 13, which is an image exposing means, according to an image signal. In this image exposing processing, an image signal is inputted to the laser writing unit 13 from a computer or an image signal inputted from an image reading unit is processed by an image signal processing unit and then inputted to the laser writing unit 13 and a latent image is formed on the photosensitive drum 10.

The laser writing unit 13 scans an image by bending the optical path from a light source of a laser diode, which is not shown in the drawing, by a plurality of reflecting mirrors via a rotational polygon mirror and an fO lens and a latent image is formed by rotation (secondary scanning) of the photosensitive drum 10. According to this embodiment, the image section is exposed to light according to the above image signal and a reversal latent image is formed so that the image section is set to VL (−100 V to 0) which is a low absolute value of potential.

On the periphery of the photosensitive drum 10, developing units 14, which contain developers including negatively charged toners T such as yellow (Y), magenta (M), cyan (C), and black (K) and carriers respectively, are mounted. The first color is developed first by a developing sleeve 143 containing a magnet and holding a developer which rotates. Each developer includes a carrier of insulating resin which is coated on cores of ferrite and a toner T which uses polyester as a main material and is added with a pigment according to the color, charge control agent, silica, and titanium oxide, and is controlled to a layer thickness ranging from 300 to 800 um on the developing sleeve 143 by a layer forming bar, and conveyed to the developing region.

The gap between the developing sleeve 141 and the photosensitive drum 10 in the developing region is larger than the layer thickness (developer) such as between 0.4 and 1.0 mm and an AC bias voltage VAC (1.5 to 3.0 KVp-p) and a DC bias voltage VDC (−500 to −700 V) are simultaneously impressed between the developing sleeve 143 and the photosensitive drum 10. Since VDC, VH, and the charge of the toner T are equal in polarity, the toner T which is given a chance for separating from the carrier by VAC will not be adhered to the portion of VH having an absolute value of potential which is higher than VDC and an amount of toner corresponding to the potential difference is adhered to the portion of VL having an absolute value of potential which is lower than VDC so as to visualize an image (reversal development).

When the first color visualization ends, the second color image forming process starts, and the peripheral surface of the photosensitive drum is uniformly charged by the scorotron charging unit 12 once again, and a latent image is formed by the image exposing means 13 according to the second color image data. In this case, discharging by PCL11 is not performed because the toner T adhered to the image section for the first color scatters due to a sudden decrease of the surrounding potential, though it is performed in the first color image forming process.

In the portion of the photoconductor with no first color image when the overall peripheral surface of the photosensitive drum 10 is controlled to the potential of VH, a latent image which is the same as that of the first color is formed and developed once again. On the part of the portion with the first color image for performing image exposing and developing once again, a latent image of VT is formed by light shielding by the adhered first color toner T and by the charge of the toner itself and developed depending on the potential difference between VDC and VT. When the first color is developed by forming a latent image of VL on the part where the first and second color images overlap, the first and second colors become unbalanced. Therefore, the exposure for the first color may be reduced so as to set an intermediate potential such as VH >VM (−100 to −300 V)>VL.

Also for the third and fourth colors, the image forming processing used for the second color is performed and a 4-color toner image is formed on the peripheral surface of the photosensitive drum 10.

On the other hand, a recording paper P which is fed by a paper feed mechanism 22 and a timing roller 24 from a paper feed cassette 21 in synchronization with the above toner image on the photosensitive drum 10 is fed to the transfer section by a transfer belt unit 30 with a tensioned transfer belt 31 which is a conveying member. The multi-color toner image on the peripheral surface of the photosensitive drum 10 is transferred onto the recording paper P in a batch.

The transfer belt 31 is an endless rubber belt consisting of a polyurethane rubber substrate and an outer FLC layer with a thickness of 0.4 to 1.0 mm which has a resistance ranging from $10^6$ to $10^{14}$ ohm.cm and may have ribs at both edges thereof so as to prevent shifting during rotation.

A highly resistant belt such as a PET film belt or a PET-coated belt may be used if a discharging mechanism is installed.

Figure 2:
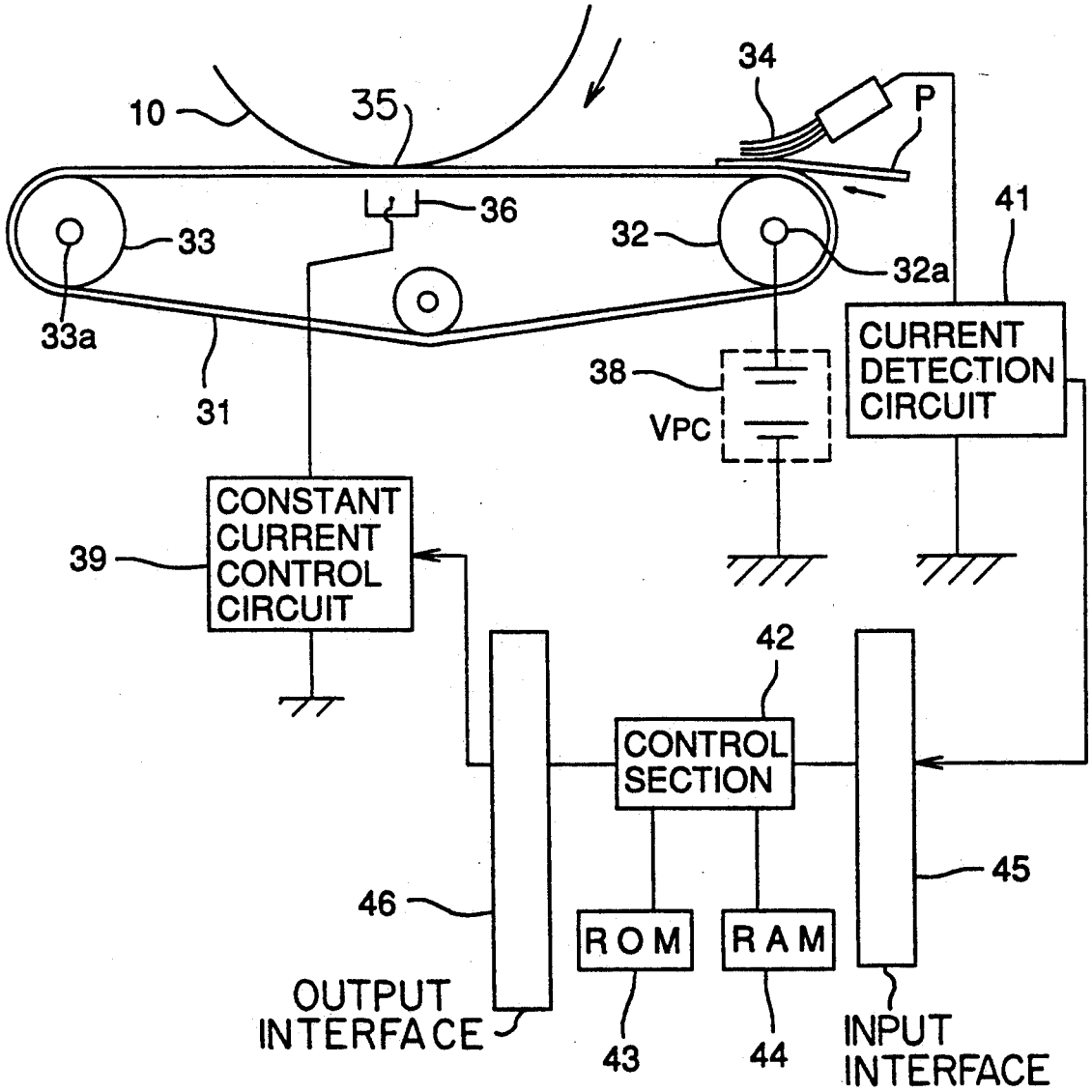
FIG. 2 is a block diagram of the essential circuits.

As shown in FIG. 2, among holding rollers 32 and 33 for tensioning the transfer belt 31, a voltage of Vpc is applied to a shaft 32*a* of the upstream holding roller 32. A conductive brush 34 is mounted at the location opposite to the shaft 32*a* via the transfer belt 31 in the grounded state as charging means for the recording paper P. The fed recording paper P enters between the brush 34 and the transfer belt 31, and a charge is supplied to the recording paper P from the brush 34, and attractive force is generated between the recording paper P and the transfer belt 31. Then, the recording paper P enters a nipping section (transfer section) 35 formed by the photosensitive drum 10 and transfer belt 31 and is given a transfer electric field by a corona discharge unit 36 or a bias roller from the back of the transfer belt 31, and the multi-color image is transferred onto the recording paper P.

The recording paper p which is separated from the photosensitive drum 10 is separated from the transfer belt 31 after it is discharged by AC corona discharge using a shaft 33*a* of the downstream holding roller 33 for tensioning the transfer belt 31 as an opposite electrode or while it is being discharged by AC corona discharge. Numeral 37 indicates a cleaning blade for removing toner adhered to the rotating transfer belt 31. The transfer belt 31 of the transfer belt unit 30 is kept away from the photosensitive drum 19 using the shaft 33*a* of the downstream holding roller 33 as a rotation center while a multi-color image is being formed.

The recording paper P with the multi-color image which is separated from the transfer belt unit 30 is conveyed to a fixing unit 23 having two pressure rollers with a heater built in at least one of the rollers. The adhered toner is melted by heat and pressure applied between the pressure rollers, fixed on the recording paper P, and ejected from the equipment.

After transfer, the remaining toner on the peripheral surface of the photosensitive drum 10 is discharged by a static eliminator 15 using an AC corona discharge unit, sent to a cleaning unit 16, scraped off within the cleaning unit 16 by a rubber cleaning blade 16*a* which is in contact with the photoconductor, and ejected or stored by a screw. The above static eliminator 15 may be arranged so as to discharge the recording paper simultaneously as shown in FIG. 1.

The photosensitive drum 10 from which the remaining toner is removed by the cleaning unit 16 is exposed to light by PCL11, uniformly charged by the scorotron charging unit 12, and enters the next image forming cycle. During formation of a multi-color image, the cleaning blade 16*a* is kept away from the surface of the photoconductor and AC discharging by the static eliminator 15 is kept in the OFF state.

In the aforementioned image forming apparatus shown as an embodiment, the present invention detects a current flowing through the charging means, such as the brush 34, for supplying a charge to the recording paper P and attracting the recording paper P to the transfer belt 31, via the recording paper P, and controls the current of the transfer corona discharge unit 36 by the detected current. FIG. 2 shows the circuit structure.

Figure 3:
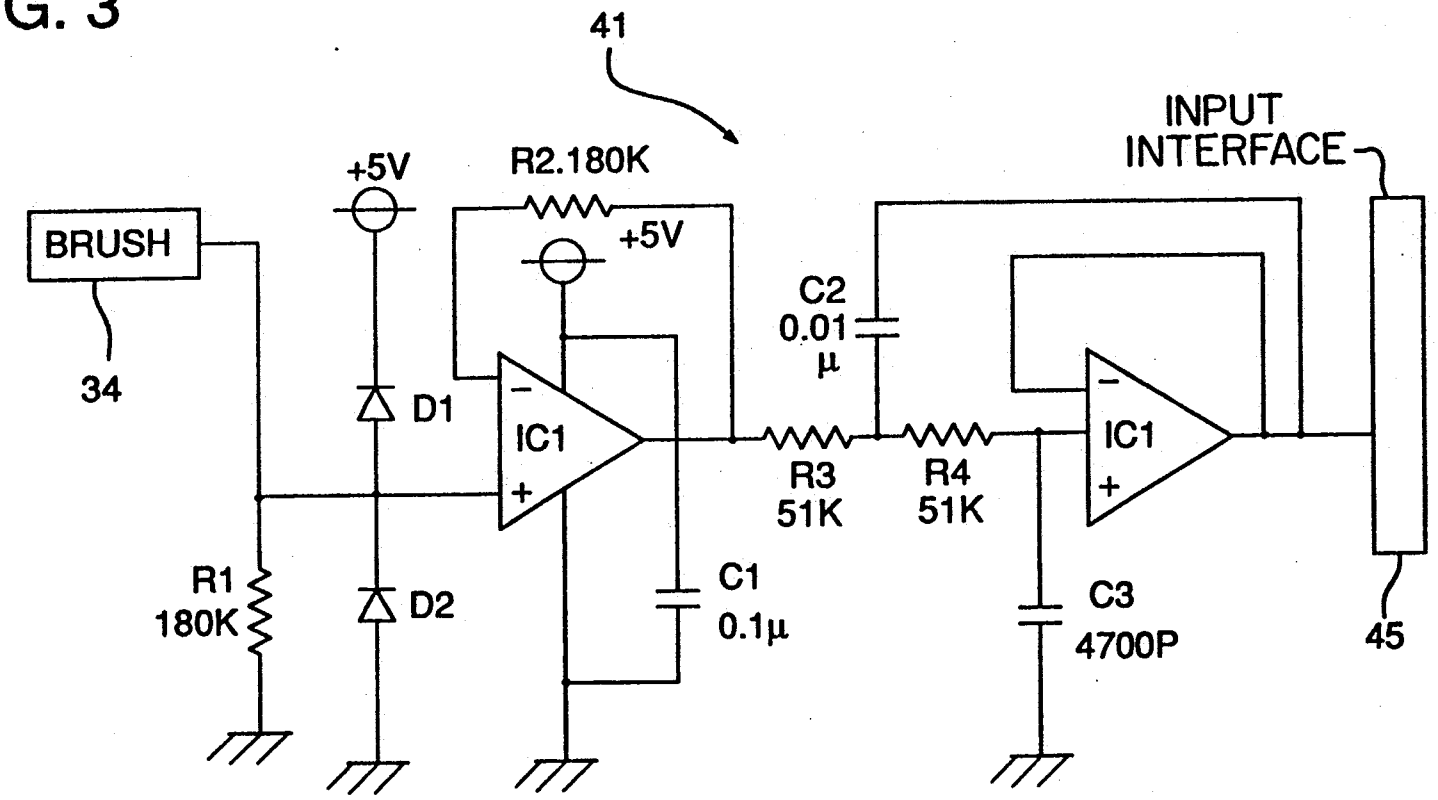
FIG. 3 shows an example of the current detection circuit.

Numeral 38 indicates a power source for applying a bias voltage of Vpc to the shaft 32*a* of the upstream holding roller 32 and the holding roller 32 is a roller which is made of a conductive metal. The brush 34 which is made of conductive fibers is always kept in the grounded state, and the tips of fibers of the brush are in contact with the transfer belt 31 during transfer, and the fed recording paper P is fed between the brush 34 and the transfer belt 31. Here, the recording paper P is supplied with a charge so as to be charged uniformly, attracted to the transfer belt 31, and sent to the transfer section. According to the present invention, the current flowing through the charging means is detected by a current detection circuit 41 when the recording paper P is passing. FIG. 3 shows a concrete circuit structure of the current detection circuit 41. The current which is converted to 0.18 V/uA is outputted to an input interface 45.

Figure 4:
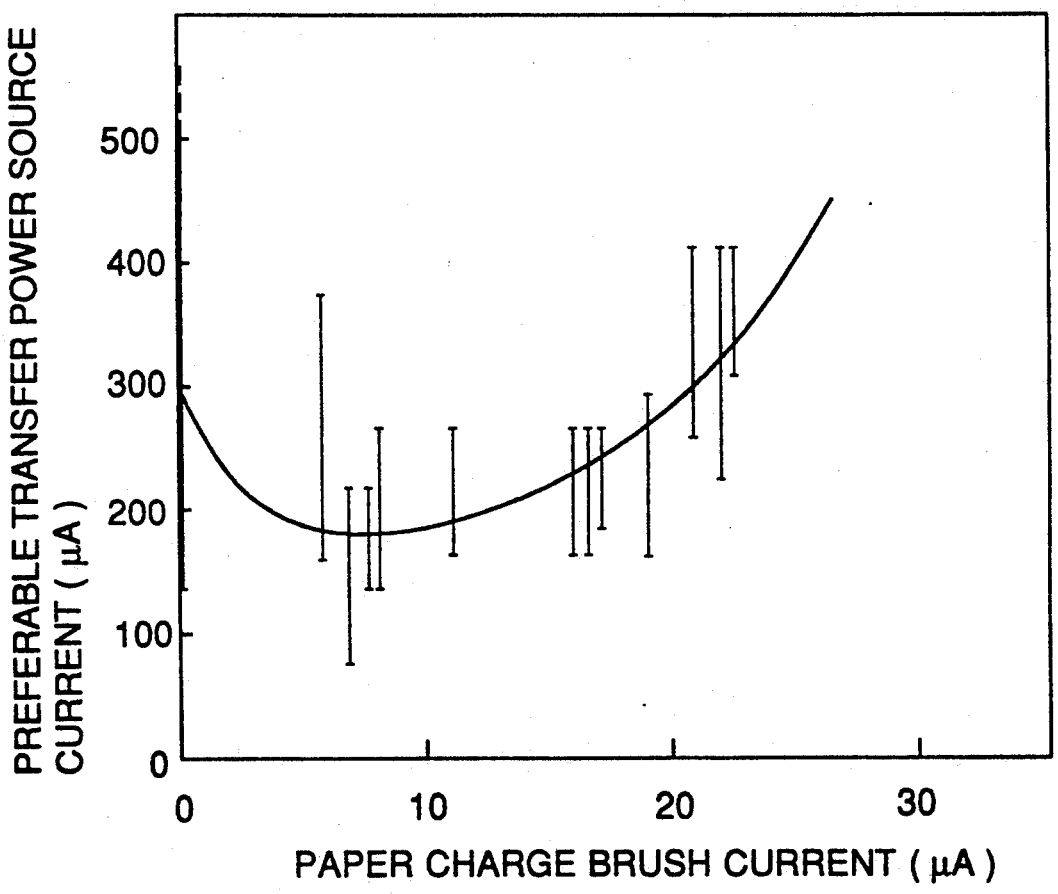
FIG. 4 is a graph showing the relationship between the paper charge brush current and preferable transfer power source current.

The inventors have obtained the relationship between the paper charge brush current of the recording paper charging means and the preferable transfer power source current, which is supplied to the corona discharge unit 36, for the transparency of various recording papers which are different in thickness and type such as postal cards and OHP. FIG. 4 shows a curve of this relationship, which is stored in a ROM 43 as a program necessary for processing input signals.

The control circuit of the present invention has a control section 42 for performing the predetermined operation for current signals, which are inputted to the input interface 45, according to the program stored in the ROM 43 and a RAM 44 for storing operation results and data temporarily, and outputs signals according to the operation results via an output interface 46, and changes the corona discharge voltage so as to control the transfer current of the constant current control circuit of the corona discharge unit 36. The aforementioned object is accomplished by this structure.

Next, a preferable embodiment of the present invention will be described.

As mentioned above, according to the present invention, a measuring means for measuring the resistance of a transfer material or of a transfer material and the conveying member of the transfer belt unit is installed, and a method that the transfer conditions are set from the measured values is used. To simplify the power source, a method that the power source output for supplying a transfer electric field is divided in voltage by a resistor so as to obtain a bias voltage for attracting a recording paper has been proposed by the applicant of this patent. However, the electric field output for supplying a transfer electric field always varies with the environmental conditions, so that the measured resistance of the recording paper varies and complete control can not be realized.

Furthermore, even when a constant voltage is applied by another power source, a transfer current flows in the current detection means from the transfer section via a transfer paper or the transfer belt at high humidity, so that the current may not be detected accurately.

The present invention presents an image forming apparatus having a transfer belt unit, which is free from the aforementioned problem and which is structured as indicated below, so as to allow good transfer without being affected by the temperature and humidity.

In an image forming apparatus having a transfer belt unit with a transfer belt which is tensioned between holding rollers and rotates so as to form a multi-color toner image by superimposing toner images on an image carrying member by repeating the charging, image exposing, and developing processes and to transfer the above multi-color toner image onto a transfer material, a power source for supplying a transfer electric field to the transfer material of the transfer belt unit and a detection means for detecting the current which is changed by the resistance of the transfer material or of the transfer material and conveying member of the transfer belt unit are installed. The output of the power source is kept at a constant value when the detection means is in operation, and the current of the power source is changed to a value selected according to the result detected by the detection means before the transfer material enters the transfer section.

Figure 6:
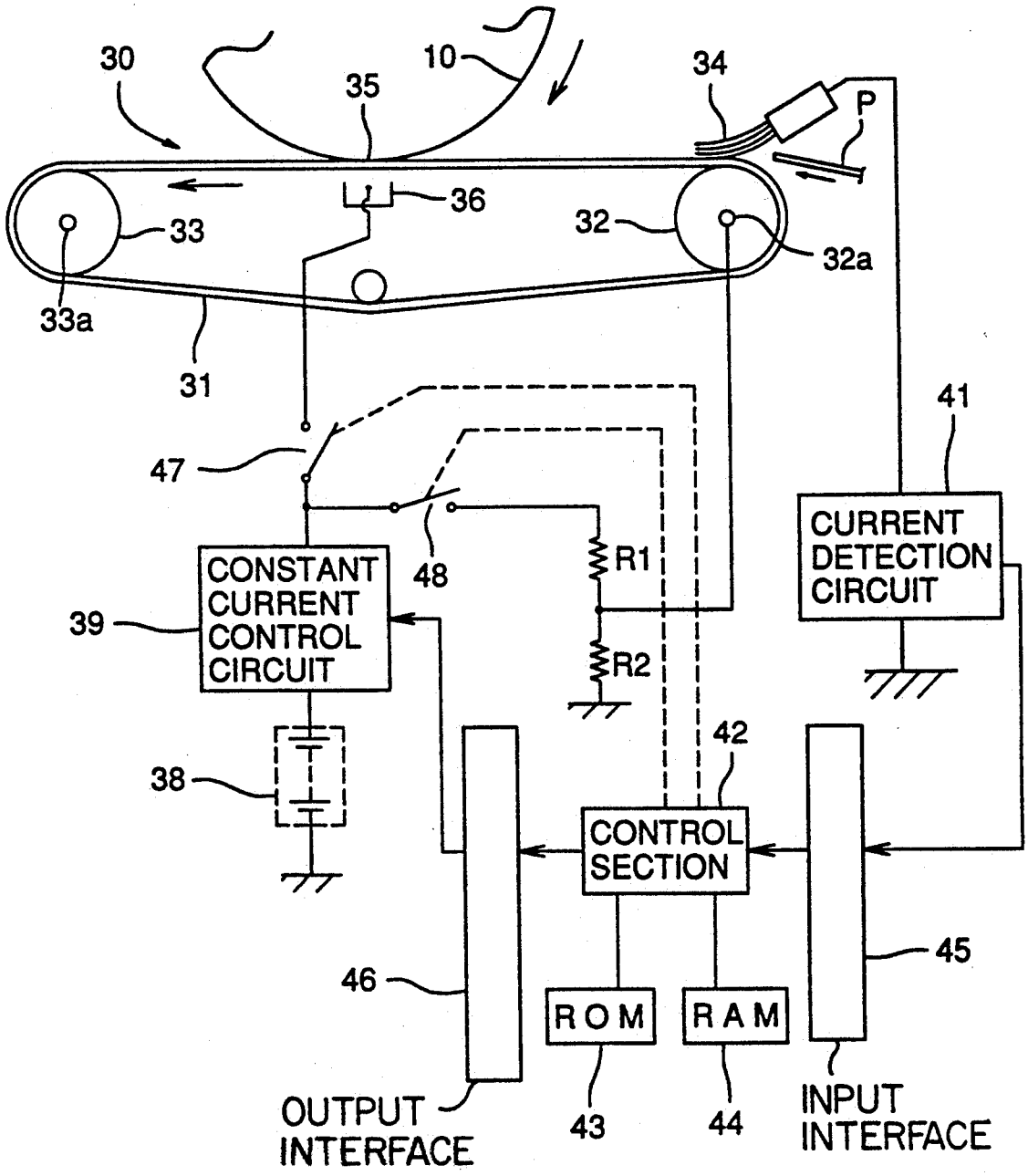
FIG. 6 is a drawing showing the circuit structure of a desirable embodiment of the transfer belt unit shown in FIG. 1.
Figure 7:
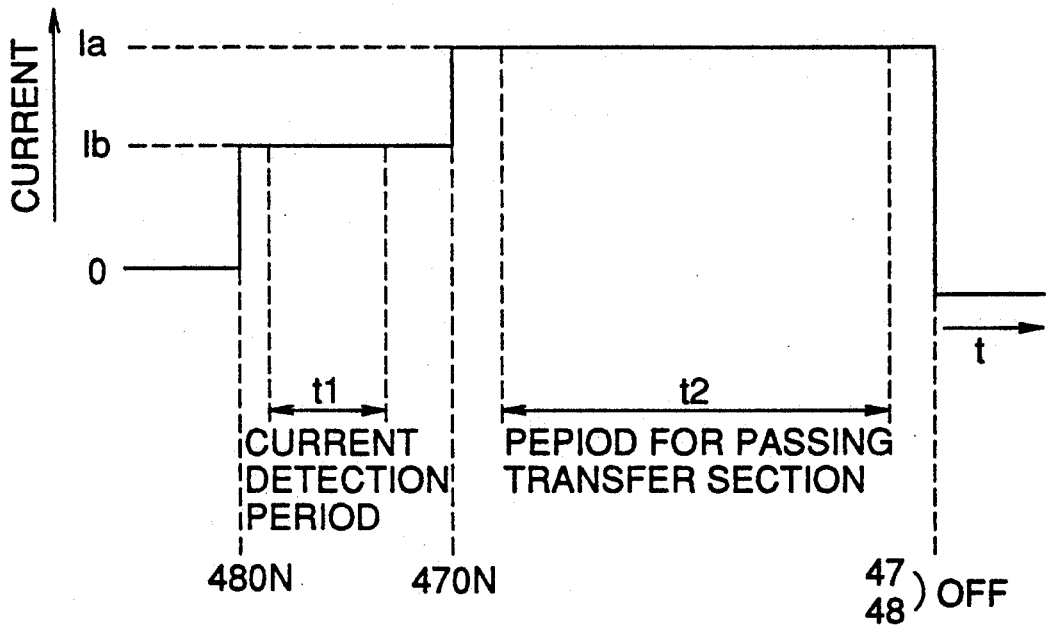
FIG. 7 is a time chart showing the relationship between current detection, transfer electric field supply, and power source output current.

According to this embodiment, the charging means such as the brush 34 for supplying a charge to the recording paper P so as to attract the recording paper P to the transfer belt 31 is installed, and the current which flows through the contact portion of the brush with the recording paper P and varies with the resistances of the recording paper P and transfer belt 31 is detected, and the current of the power source for the transfer unit 36 is controlled by the detected current. FIG. 6 shows a concrete circuit structure and FIG. 7 is a time chart showing the relationship between the above current detection, transfer electric field supply, and power source output current.

In FIG. 6, numeral 38 indicates a power source for supplying a bias voltage of about 6 KV to the transfer unit 36, which is composed of a corona discharge unit, via a switch 47 and a constant current control circuit 39. The output from the power source 38 and constant current control circuit 39, which is divided to a bias voltage of about 2 KV by resistors R1 and R2, is applied to the shaft 32*a* of the upstream holding roller 32 via a switch 48. The holding roller 32 is a roller which is made of a conductive metal. The brush 34 which is made of conductive fibers is always grounded or kept in the grounded state via a non-linear element or a resistor, and the tips of fibers of the brush are in contact with the transfer belt 31 during transfer, and the fed recording paper P is fed between the brush 34 and the transfer belt 31. During the time including the current detection period t1 shown in FIG. 7 from immediately before the top end of the recording paper P enters between the transfer belt 31 and the brush 34 to a little before the top end of the recording paper P reaches the transfer section 35, the switch 48 is kept on under control of the control section 42 and the output of the power source 38 whose current is always controlled to a constant current Ia by the constant current control circuit 39 controlled by the control section 42, which is divided to a bias voltage, is applied to the holding roller 32 as shown in FIG. 7. Therefore, the recording paper P is supplied with a charge so as to be charged uniformly. By doing this, the recording paper P is attracted to the transfer belt 31 and conveyed to the nipping section (transfer section) 35. The current flowing through the brush 34 (charging means) is detected by the current detection circuit 41 when the recording paper P is passing. The concrete circuit structure of the current detection circuit 41 is the one shown in FIG. 3 which is already explained.

The control circuit of the present invention has a control section 42 for performing the predetermined operation for current signals, which are inputted to an input interface 45, according to the program stored in a ROM 43 and a RAM 44 for storing operation results and data temporarily, and outputs signals according to the operation results via an output interface 46. By doing this, the control section 42 keeps the switch 47 on during the time including the period for passing the transfer section t2 shown in FIG. 7 from immediately before the top end of the recording paper P enters the transfer section 35 until the back end of the recording paper P passes the transfer section 35 and controls the current supplied to the transfer unit 36 to the current Ib which is determined by the above operation result by the constant current control circuit 39 so as to maintain the corona discharge voltage of the transfer unit 36 at a preferable value, and a multi-color toner image on the photosensitive drum 10 is transferred onto the recording paper P in a batch. According to this structure, the current (resistance) is detected always at a constant bias voltage and a preferable transfer electric field corresponding to the environmental conditions can be supplied to the transfer unit 36 according to the detection result.

In this embodiment, an example that the brush 34 is used as a charging means for the recording paper P is explained. However, a conductive roller which rotates on the transfer belt may be used instead of the brush 34.

Furthermore, an example that the output of the power source 38 for the transfer unit 36 which is divided in voltage is used as a power source for the holding roller 32 is explained. However, the power source 38 for the transfer unit 36 and the power source for the holding roller 32 may be independent of each other.

Furthermore, in this embodiment, a constant current is outputted for detection. However, a constant voltage may be outputted, though the relationship shown in FIG. 4 is just changed. Furthermore, the output for controlling may be a voltage instead of a current.

Furthermore, in this embodiment, the corona discharge unit mounted on the back of the transfer belt is explained also as a transfer means to a recording paper. However, a bias roller which is mounted behind and in contact with the transfer belt and rotates may be used.

The present invention presents an image forming apparatus for always forming good transferred images regardless of the recording paper thickness and humidity using a charging means for a recording paper installed in the image forming apparatus unless a heater, hygrometer, and resistance measuring instrument are installed in the apparatus as conventional.

Another preferable embodiment of the present invention will be described.

As to control over the image forming conditions or transfer conditions by detecting the current, control over delicate differences in the environment is not always satisfactory. According to this embodiment, to present an image forming apparatus for always obtaining stable and good images which are free of instability under highly accurate control in correspondence with changes in the environment, the apparatus is structured as indicated below.

In an image forming apparatus which has image forming means such as a charging means, image exposing means, and developing means on the periphery of an image carrying member which rotates, transfers toner images formed on the image carrying member via the charging, image exposing, and developing processes onto a transfer material conveyed by a transfer material conveying member, and fixes the transferred toner images, a detection means for detecting the current flowing through the transfer material and/or the transfer material conveying member and a shielding member for shielding the detection means from external electromagnetic waves are installed.

Figure 8:
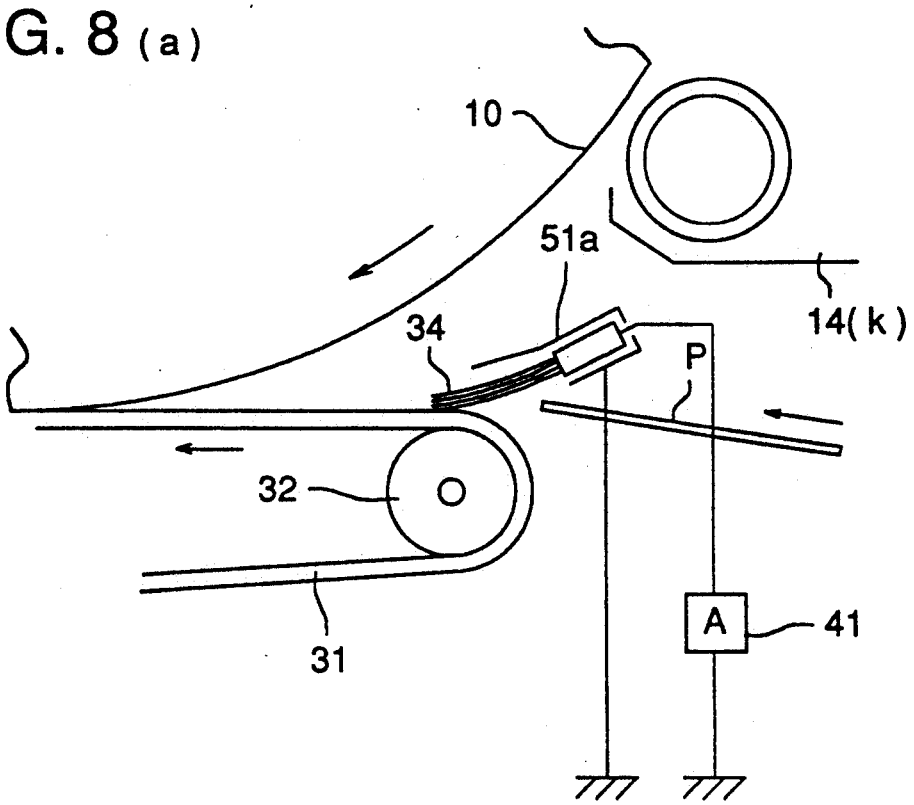
FIGS. 8(*a*) and 8(*b*) show an embodiment showing the detection member shielding status.
Figure 8:
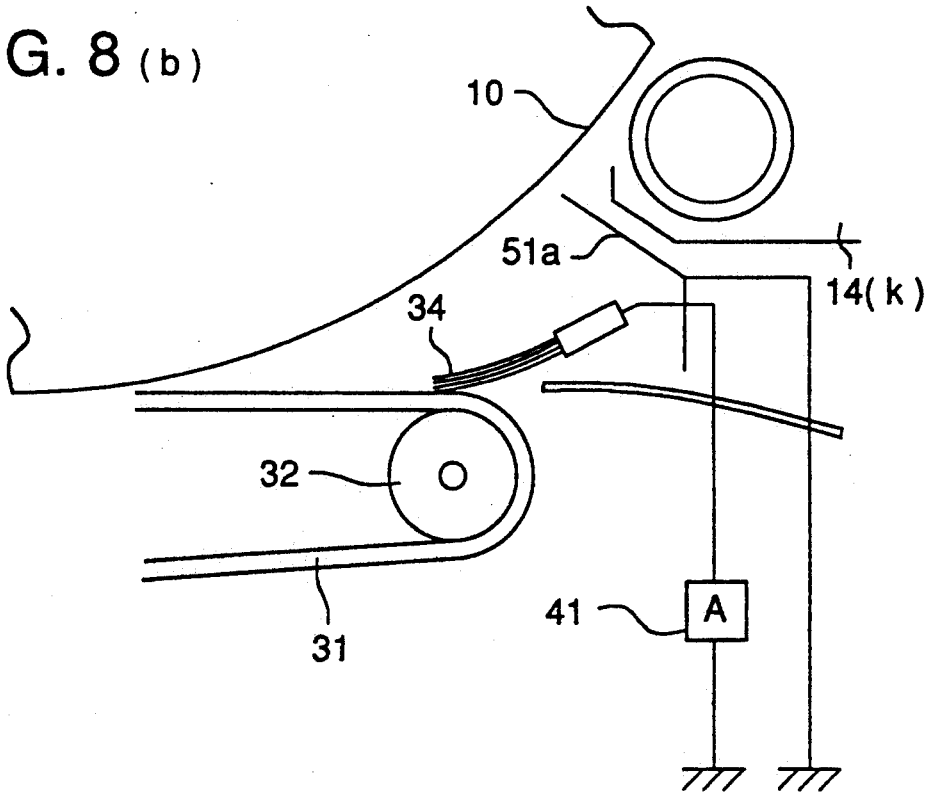

According to this embodiment, a shielding member for shielding the brush 34 which is a detection means from external electromagnetic waves and FIGS. 8(*a*) and 8(*b*) show embodiments of the shielding member. As shown in FIG. 1, the brush 34 is mounted in the neighborhood of the developing unit 14. As mentioned above, an AC bias voltage $V_{AC}$ and a DC bias voltage $V_{DC}$ are simultaneously applied to the developing unit 14. Therefore, if no shielding member is installed between the brush 34 and the developing unit 14, a current will be induced in the brush 34. The actual measurement when the distance between the developing unit and the end portion of the brush holder is 2 to 3 mm shows that an AC bias voltage $V_{AC}$ of 2 to 3 KVp-p and a DC bias voltage $V_{DC}$ of −500 to −800 V are applied to the developing unit 14 and a current of −10 to −30 uA is induced resultantly in the brush 34. When such an induced current is generated in the detection means, accurate process control according to current detection becomes impossible.

FIG. 8 shows an embodiment that the brush 34 which is a detection means is surrounded by a shielding member 51*a* such as a thin iron plate and the shielding member 51*a* is grounded. FIG. 9 shows an embodiment that a shielding member 51*b* such as a thin iron plate is mounted between the brush 34 and the developing unit 14 and the shielding member 51*b* is grounded. When the shielding member 51*a* which is grounded so as to cover the brush 34 is arranged as mentioned above or the shielding member 51*b* which is grounded so as to partition between the developing unit 14 and the brush 34 is arranged, the induced current is controlled to at most 1 uA and process control corresponding to changes in the environment and the transfer material type can be applied. There is no need to mount such a shielding member separately; that is, it is possible to make a part of the casing of the developing unit conductive and ground it or to wind aluminum or copper foil round the brush holder and ground it.

According to this embodiment, noise from the developing unit is shielded. When the apparatus is designed so that a noise source such as a high voltage power source or a discharge electrode is mounted in the neighborhood of the detection member, the present invention is also effective.

As mentioned above, the present invention presents an image forming apparatus wherein since the apparatus is structured so that the current is detected by a charging means at a constant bias voltage and the transfer power source output is controlled by the detection result, images are always transferred by a preferable transfer electric field corresponding to the environmental conditions and good transferred images free of effects of the environmental conditions such as temperature and humidity can be always obtained.

What is claimed is:

1. An apparatus for forming a toner image on a recording sheet, the apparatus comprising:

a photoreceptor having a movable imaging surface on which a toner image may be formed, and transfer means for transferring the toner image from the imaging surface to the sheet at a transfer portion of the photoreceptor, the transfer means including a conveying member to convey the sheet to the transfer portion, means for providing the sheet with an electric charge so that the sheet is attracted onto the conveying member, means for detecting an electric current passing through the providing means to the sheet.

a shielding member to shield the detecting means from external electromagnetic waves, and means for controlling a transfer condition of the transfer means for the sheet in accordance with the detected electric current.

2. The apparatus of claim 1, wherein the transfer means further includes a transfer electric source to provide a transfer electric field to the transfer portion, and further wherein the controlling means controls the transfer electric source to change an output thereof in accordance with the detected electric current.

3. The apparatus of claim 2, wherein the controlling means includes a memory for storing the output of the transfer electric source which corresponds to each possible electric current detected by the detecting means, so that the output of the transfer electric source is determined when the detected electric current addresses the memory.

4. The apparatus of claim 2, wherein the output of the transfer electric source to be controlled is an electric current.

5. The apparatus of claim 2, wherein the providing means is electrically connected to the transfer electric source, and further wherein, when the detecting means detects the electric current passing through the providing means, the controlling means controls the transfer electric source to keep the output at a constant.

6. An apparatus for forming a toner image on a recording sheet, the apparatus comprising:

a photoreceptor having a movable imaging surface on which a toner image may be formed, and transfer means for transferring the toner image from the imaging surface to the sheet at a transfer portion of the photoreceptor, the transfer means including a conveying member to convey the sheet to the transfer portion, means for providing the sheet with an electric charge so that the sheet is attracted onto the conveying member, means for detecting an electric current passing through the providing means to the sheet, a transfer electric source to provide a transfer electric field to the transfer portion, wherein the providing means is electrically connected to the transfer electric source, and means for controlling a transfer condition of the transfer means for the sheet in accordance with the detected electric current, wherein the controlling means controls the transfer electric source to keep an output thereof at a constant when the detecting means is detecting the electric current passing through the providing means.

7. The apparatus of claim 6, wherein, after the detecting means detects the electric current passing through the providing means, the controlling means controls the transfer electric source to change the output thereof in accordance with the detected electric current.

8. The apparatus of claim 7, wherein the controlling means includes a memory for storing the output of the transfer electric source which corresponds to each possible electric current detected by the detecting means, so that the output of the transfer electric source is determined when the detected electric current addresses the memory.

9. The apparatus of claim 6, wherein the output of the transfer electric source to be controlled is an electric current.

* * * * *